United States Patent [19]

Grieve

[11] 4,094,631

[45] June 13, 1978

[54] MULTIPLE OUTLET BLOWER SCROLL FOR AN INDUSTRIAL OVEN

[76] Inventor: Douglas V. Grieve, 212 Hazelwood Dr., Lindenhurst, Ill. 60046

[21] Appl. No.: 781,680

[22] Filed: Mar. 28, 1977

Related U.S. Application Data

[63] Continuation of Ser. No. 649,406, Jan. 15, 1976, abandoned.

[51] Int. Cl.[2] ..... F27B 3/22

[52] U.S. Cl. ..... 432/176; 432/194; 432/203; 126/21 A; 415/211; 34/225

[58] Field of Search ..... 432/175, 176, 184, 194, 432/201-203, 165, 152; 126/21 A; 34/195-197, 219, 225, 231; 415/206, 211

[56] References Cited

U.S. PATENT DOCUMENTS

| | | | |
|---|---|---|---|
| 478,307 | 7/1892 | Bee | 415/211 |
| 1,996,680 | 4/1935 | Lobley | 126/21 A |
| 2,553,742 | 5/1951 | Bloch | 415/211 |
| 2,918,254 | 12/1959 | Hausammann | 415/211 |
| 3,069,070 | 12/1962 | Macaluso et al. | 415/211 |
| 3,304,071 | 2/1967 | Gentry | 432/168 |
| 3,324,844 | 6/1967 | Huffman | 34/225 |
| 3,668,817 | 6/1972 | Bell | 34/225 |
| 3,719,180 | 3/1973 | Pere | 126/21 A |
| 3,873,231 | 3/1975 | Callahan | 415/211 |

*Primary Examiner*—John J. Camby
*Assistant Examiner*—Henry C. Yuen
*Attorney, Agent, or Firm*—Mason, Kolehmainen, Rathburn & Wyss

[57] ABSTRACT

An industrial oven having a housing defining a work chamber into which products to be treated by the oven may be placed includes a duct system communicating with a blower wheel mounted in the work chamber for communicating air blown by the wheel to the work chamber. The industrial oven further includes the improvement of a blower scroll consisting of a plurality of plates mounted about the blower wheel in an involute configuration. The blower plates define a plurality of outlets for uniformly directing air from the wheel to the duct system.

2 Claims, 4 Drawing Figures

MULTIPLE OUTLET BLOWER SCROLL FOR AN INDUSTRIAL OVEN

This application is a continuation of application Ser. No. 649,406 filed Jan. 15, 1976 now abandoned.

BACKGROUND OF THE INVENTION

A. Field of the Invention

The present invention relates to a scroll having a plurality of plates mounted about a blower wheel in an industrial oven. The scroll serves to deliver hot air from the blower wheel uniformly in more than one direction without loss in efficiency of the blower wheel or volume of air delivered by the wheel.

B. Description of the Prior Art

Typically, industrial ovens are of a capacity sufficient to contain several objects intended to be cured or treated by the oven. These objects must be treated by the oven over a short period of time to insure efficient production. To increase the treatment efficiency of prior art industrial ovens, a blower wheel is normally employed in conjunction with a duct system extending around the inner periphery of the work chamber of the oven.

In this manner, hot air within the oven is circulated throughout the work chamber passing over the objects to be treated. This increases the heating and drying efficiency of the oven resulting in a faster rate of treatment.

However, typical prior art industrial oven blower wheels have been unable to deliver air at the increased capacities necessary for the larger industrial ovens. Accordingly, several solutions have been attempted, one of which is to use a larger horsepower motor to operate the blower wheel thus increasing the volume and flow capacity. However, such a solution is expensive and the larger horsepower in the same work chamber area results in reduced efficiency.

The employment of a supply plenum with a plurality of outlets has also been used in prior art devices but also suffers undesirable losses in efficiency.

SUMMARY OF THE INVENTION

An object of the present invention is to provide a new and improved device for uniformly and efficiently distributing heated air from a blower wheel to the work chamber of an industrial oven.

Another object of the present invention is to provide a new and improved scroll assembly having at least two outlets for uniformly distributing air from a blower wheel in an industrial oven to a duct system in the oven work chamber.

Briefly, the present invention is directed to an improved industrial oven that includes a blower wheel for drawing air from within the work chamber and forcing the heated air through a duct system to be circulated throughout the work chamber. The work chamber includes supports for racks onto which may be mounted a plurality of objects intended to be treated by the oven.

The oven further includes a scroll consisting of a plurality of plates mounted in an involute configuration about the blower wheel. The plates define a plurality of outlets which uniformly distribute the air blown by the wheel to the duct system.

The entire peripheral surface of the blower wheel is covered by the blower scroll plates to insure identical flow form each outlet. However, if the available space within the oven is insufficient for the full scroll, the scroll plates are mounted within the limited space and shortened such that portions of the blower wheel are not covered by the plates. The area of each outlet defined by the shortened scroll plates will be identical such that the air blown by each outlet will remain uniform.

BRIEF DESCRIPTION OF THE DRAWINGS

The above and other objects and advantages and novel features of the present invention will become apparent from the following detailed description of a preferred embodiment of the invention illustrated in the accompanying drawings wherein.

DESCRIPTION OF THE PREFERRED EMBODIMENT

Figure 1:
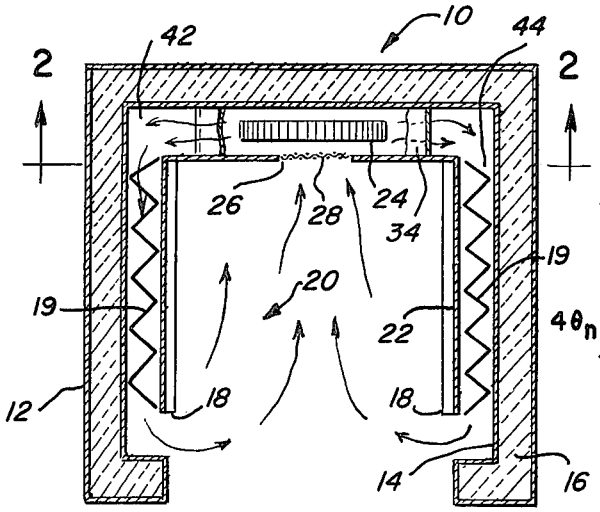
FIG. 1 is a cross-sectional illustration of an industrial oven including an improved scroll constructed in accordance with the principles of the present invention.
Figure 2:
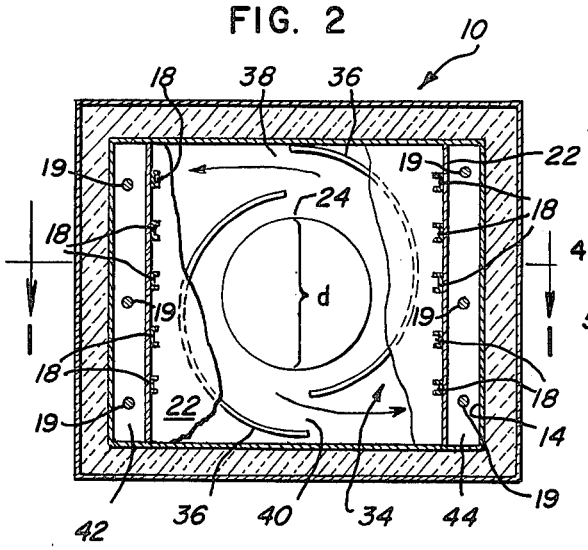
FIG. 2 is a cross-sectional view of the device of the present invention taken along the line 2—2 of FIG. 1.

With reference to FIGS. 1 and 2, there is illustrated a conventional industrial oven 10. The industrial oven 10 includes an outer housing 12 typically fabricated from metal such as steel or the like.

In addition, the oven 10 includes an inner housing 14 of a similar material. Mounted between the outer 12 and the inner 14 housings is a thickness of insulation 16. This insulation maintains the outer housing 12 at a much reduced temperature level than that of the inner housing 14.

Industrial ovens of the type disclosd are normally used to heat treat a variety of objects. These objects are normally mounted on racks (not shown) secured in supports 18 mounted in the work chamber 20 of the industrial oven 10. Since the industrial oven 10 is usually employed for high volume production capacity, efficient treatment over a short period of time is necessary.

One method of increasing the efficiency of treatment and reducing the time required is to circulate hot air over the objects mounted in the work chamber 20. In order to circulate the air through the work chamber 20, a duct system 22 and a blower wheel 24 are employed. Air is drawn through an inlet 26 to the blower wheel 24 through a screen or filter 28. The air is then circulated through the duct system 22 by the wheel 24.

In order to force air in more than one direction and to maintain uniform distribution of the air throughout the duct system thereby increasing the efficiency of the operation, a multiple outlet scroll 34 is employed. The multiple outlet scroll 34, in the preferred embodiment, includes scroll plates 36 (FIG. 2). The scroll plates 36 are mounted about the blower wheel 24 in an involute configuration.

In the embodiment illustrated, the plates 36 define two outlets 38 and 40 to supply air to the two passages 42 and 44 of the duct system 22. However, if more passages are desired, additional plates 36 could be added in accordance with the procedure to be described thereby increasing the number of outlets.

In order to ascertain the proper plate 36 length and scroll 34 configuration for a desired number of outlets in a given space limitation, two design methods are used. The first design is followed where there is no physical limitation to scroll size. In designing the proper blower scroll 34 (FIG. 3), a standard blower wheel 24 and scroll are used. Thereafter, the desired number of outlets is determined; for example, assume that $n$ outlets are desired. Having chosen these parameters, the angular length of each plate 136 may be determined.

The perimeter of 360° of the wheel is divided by the number of desired outlets $n$ to get the angular length ($\theta_n$) of each scroll plate 136. Next, the radial distance $r_o$ of the beginning point 46 and the radial distance $r$ of the end point 52 of each plate 136 must be determined.

Figure 3:
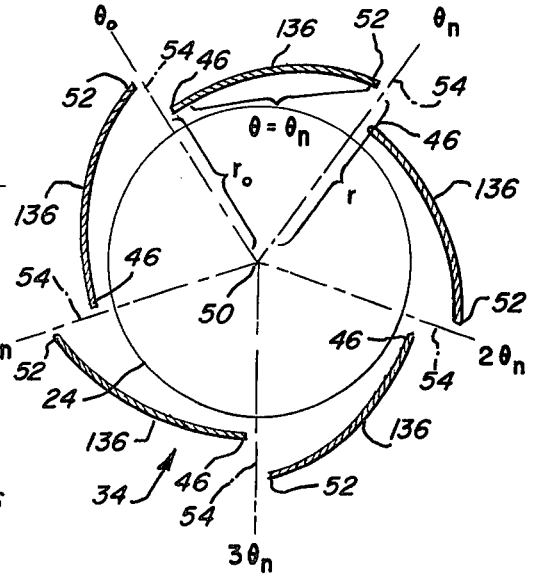
FIG. 3 is a diagrammatic illustration of the device of the present invention.

The radial distance $r_O$ from the center 50 of the blower wheel 24 is chosen and serves as the point of closest approach 46 of the first scroll plate 136 (FIG. 3). This radial distance $r_O$ is the distance from the center 50 of wheel 24 to the point of closest approach of a standard, single outlet involute scroll (not shown) when placed about the blower wheel 24. The point of closest approach 46 is given the angular designation $\theta = 0°$.

Knowing the angular length $\theta_n$ and the point of closest approach 46 of each plate 136, the radial distance $r$ of each end point 52 may be determined. More specifically, the radial distance $r$ at $\theta = \theta_n$ (or the end point 52 of the first plate 136) on the improved scroll 34 equals $r_n$, the radial distance from the center 50 of the wheel to the point at $\theta = \theta_n$ on a standard scroll, plus the distance between the blower wheel 24 and the scroll 34 at the point of closest approach 46. Mathematically this is expressed as: $r = r_n + r_O -$ to $(d/2)$ where $d$ is the diameter of the wheel 24.

This radial distance $r$ can be mathematically determined since involute scrolls are based on conserving the moment of momentum of air within the casing of the scroll. The general formula for an involute scroll is: $\theta - \theta_0 = K \log (r/r_O)$.

Solving this equation for $K_n$ results in the equation:

$$K_n = \left[ \frac{\theta - \theta_0}{\log \dfrac{r_n + r_0 - \frac{d}{2}}{r_0}} \right]$$

Using $K = K_n$ and $\theta_O = 0°$, the equation for a scroll plate 136 from $\theta_O$ to $\theta_O$ or from point 46 to point 52 is:

$$\left[ \frac{\theta + K_n \log r_0}{K_n} \right]$$

$r = 10$

This equation can be used to determine the radial distance ($r$) for point on the plates 36. Since $n \cdot (\theta_n)$ equals 360°, as previously defined, a series of $n$ plates 136 starting at $\theta = O, \theta_n, 2\,\theta_n, \ldots n\theta n$ will result in $n$ outlets around the perimeter of the blower wheel 24.

The peripheral face area of the blower wheel 24 associated with each outlet 54 is identical, since the end point 52 is on the same radius as the point of closest approach 46 of the next plate 136. Thus, the air output through each outlet 54 will also be identical.

In certain ovens there may be a physical limitation to the space available for mounting a scroll 34. Accordingly, a different design method must be employed. The previously described design method is employed but $r_n$ becomes the maximum radial distance from the center 50 of the blower wheel 24 to the end of the scroll plate 236. Accordingly, the outlets 154 may become too small such that the sum of all the outlet 154 areas is inadequate to provide the most efficient distribution of air.

Figure 4:
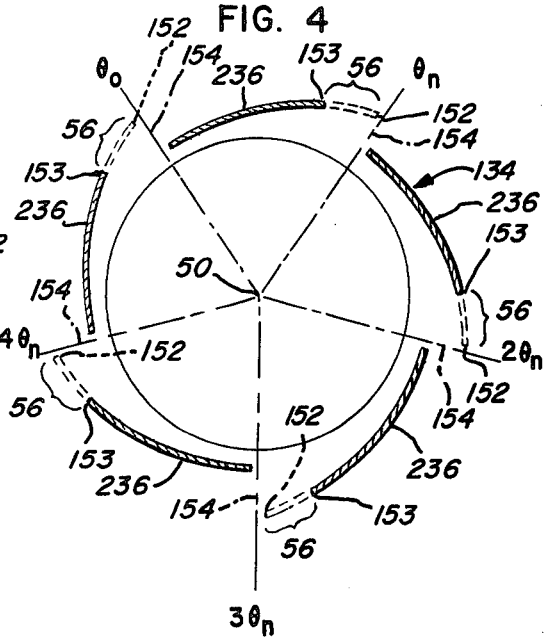
FIG. 4 is a diagrammatic illustration of an alternative embodiment of the device of the present invention.

To compensate for the inadequate outlet area, the individual scroll plates 236 may be shortened by a uniform amount 56 from the calculated end point 152 to point 153 (FIG. 4). This results in a less efficient design since part of the wheel 24 is now not scrolled; however, the peripheral face area of the wheel 24 associated with each outlet 154 is still identical and therefore the air output through each outlet 154 is identical resulting in a uniform overall output.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. An improved industrial oven of the type including a housing defining a work chamber, a duct system including a plurality of passages within said chamber, a plurality of heating elements mounted within said passages, a blower wheel mounted within said chamber and communicating with said duct system for forcing air through said passages so as to circulate hot air through said chamber, wherein the improvement comprises:

a blower scroll mounted around said blower wheel;

said scroll having a plurality of radial outlets, each said outlet being aligned with a single passage, to allow air to pass therethrough into said passages, said scroll defined by a plurality of short, curved circumferentially extending individual plates equal in number to the number of said outlets, said plates surrounding said wheel and of a size such that the circumferential face area of said wheel surrounded by each of said plates is the same, said plates being of a short length such that circumferential portions of said wheel are uncovered.

2. The industrial oven claimed in claim 1, said scroll being of an involute configuration.

* * * * *